US006772969B2

(12) United States Patent
Tokui et al.

(10) Patent No.: US 6,772,969 B2
(45) Date of Patent: Aug. 10, 2004

(54) BREAK ROLL MACHINE OPERABLE WITH EASE IN REPLACEMENT OF THE ROLLS

(75) Inventors: Yoshihiro Tokui, Tokyo (JP); Yasushi Hisamitsu, Tokyo (JP); Makoto Miyaji, Tokyo (JP); Shigeki Uebayashi, Tokyo (JP); Hiroyuki Kawano, Tokyo (JP)

(73) Assignee: Satake Corporation, Tokyo (JP)

( * ) Notice: Subject to any disclaimer, the term of this patent is extended or adjusted under 35 U.S.C. 154(b) by 116 days.

(21) Appl. No.: 10/194,846

(22) Filed: Jul. 11, 2002

(65) Prior Publication Data

US 2003/0019965 A1 Jan. 30, 2003

(30) Foreign Application Priority Data

Jul. 12, 2001 (JP) ..... 2001-212245

(51) Int. Cl.[7] ..... B02C 4/42
(52) U.S. Cl. ..... 241/101.2; 241/234
(58) Field of Search ..... 241/101.2, 230–234, 241/285.2, 143

(56) References Cited

U.S. PATENT DOCUMENTS 6,145,767 A * 11/2000 Hostettler ..... 241/135

FOREIGN PATENT DOCUMENTS

GB 2265844 A * 10/1993

* cited by examiner

*Primary Examiner*—Mark Rosenbaum
(74) *Attorney, Agent, or Firm*—Wells St. John P.S.

(57) ABSTRACT

A break roll machine wherein a timing belt of a differential transmission mechanism can be removed easily and wherein the removal of a roll pack module from a machine frame and the installation of the new pre-assembled roll pack module can be performed easily in a short time is disclosed. A cutout portion is provided to one of a paired tension arms so that the one tension arm is rotatable around a pivot point at an upper portion of the tension arm. As a rotary shaft of an idler pulley is released from the tension arm through the cutout portion, the timing belt can be removed easily. An air cylinder is rotated freely by a first and a second linkage member. An operator can easily access to a bolt located behind the air cylinder only by inclining the air cylinder at any desired direction.

3 Claims, 5 Drawing Sheets

BREAK ROLL MACHINE OPERABLE WITH EASE IN REPLACEMENT OF THE ROLLS

RELATED APPLICATIONS

This application relates to and claims a priority from corresponding Japanese Patent Application No. 2001-212245 filed on Jul. 12, 2001.

BACKGROUND OF THE INVENTION

1. Field of the Invention

The present invention relates to a break roll machine for breaking such grains as wheat grains, and more particularly to a break roll machine in which the replacement of the rolls can be performed with ease.

2. Description of the Related Art

As a break roll machine which is used in a flour milling plant, a multiple roll machine, as shown in FIG. 5, in which two sets of a pair of rolls 102, 103 are arranged in a machine frame 101 is well known in the art. The multiple break roll machine 100 is divided into two by a center partition board 104 so that two sets of the pair of rolls 102, 103 operate independently with each other. For example, the machine illustrated in FIG. 5 is divided into two parts, one being the coarse roll side 107 at which the operation of breaking and developing of the stock of raw materials is performed and the other one being the smooth roll side 108 at which the frictional breaking of the stock is performed. Further, the break roll machine 100 is provided with a differential transmission mechanism 109 (see the coarse roll side 107) for causing the pair of rolls 102 and 103 to rotate respectively inwardly at the different peripheral speeds. The roll machine 100 is also provided with a roll gap adjusting mechanism 110 for adjusting a nip or gap defined between the pair of rolls 102 and 103.

In the break roll machine 100 as described above, with the lapse of time, there develops wear of the coarse rolls, the surface of the smooth rolls becomes rough, the rolls lose their roundness, and the pear surface of the rolls becomes too smooth due to the wear. Therefore, the surfaces of the rolls 102 and 103 are required to be coarse or grinded or polished. In performing the maintenance, it is effective that the used rolls are replaced by the spare rolls sequentially according to a predetermined schedule. Although the appropriate timings of the roll replacement depend on such conditions as the locations of the rolls, the materials of rolls, kinds of raw materials, the tightening degree of the rolls, and the degree of load, span of period may be between four months to one year for the coarse rolls and between six months to two years for the smooth rolls.

Hereunder, actual operation for replacement of the rolls is explained. When the pair of rolls 102 and 103 are to be removed from the machine frame 101, it is necessary that the drive-transmission means such as belts be first removed or disassembled from the main drive means. The drive-transmission means includes, for example, a V-belt (not shown) and V-belt pulleys which connect between a drive motor (not shown either) as the drive source and the rolls (102 and/or 103). Since such V-belt pulleys are generally mounted on the end portions of the motor drive shaft and the roll driven shaft and the width of the V-belt is small, possibility of interference of these components with other components or their projection portions is small. As a result these components can be easily removed or disassembled by simply loosening the tension applied thereto.

On the other hand, a timing belt 111 of the differential transmission mechanism 109 shown in FIG. 5 has a wide width configuration, the removal or disassembling of the same is fairly difficult. The differential transmission mechanism 109 is constituted by timing-belt pulleys 112, 113 respectively mounted on the rolls 102, 103; an idler pulley 114; the timing belt 111 of the wide width configuration wound on the timing-belt pulleys 112, 113 and the idler pulley 114; a tension arm 115 on which the rotary axis of the idler pulley 114 is received; and a tension mechanism 116 which applies an appropriate tension to the timing belt 111 based on the rotation of the same. Where the timing belt 111 wound on the timing-belt pulleys 112, 113 and the idler pulley 115 is to be removed, a rod 116*a* is contracted by the operation of the tension mechanism 116 so that the tension arm 115 is pivotally rotated in the direction of left, namely, in the arrow direction in the drawings. In this way, the timing belt 111 is loosened. Next, since the pivot 115*a* of the tension arm 115 is secured to the lower portion 104*a* of the center partition board 104 by bolts, these bolts are removed and, then, the tension arm 115 itself is removed from the machine frame 101. Thereafter, the timing-belt 111 of the wide width configuration is removed from the timing-belt pulleys 112, 113 and the idler pulley 114.

After the removal of the drive-transmission means such as the V-belt and timing belts from the main drive means, the pair of rolls 102, 103 are removed from the machine frame 101. However, between the rolls 102, 102 and the machine frame 101, there is further connected a roll gap adjusting mechanism 110. The Japanese Patent Application Kokai-Publication No. Hei 8-206,522 discloses a roll pack of the pre-assembled module construction as shown in FIG. 6 in which the rolls 102 and 103 are mounted in advance in a movable bearing housing 117 and a fixed bearing housing 118, respectively. In this case, by disconnecting the circular-coupling between an arm rod 120 of the roll gap adjusting mechanism 110 and an air cylinder 121 and, further, by removing the fastening bolts 122, 123 and 124, the pre-assembled roll pack module 119 can be removed from the main frame 101 in a short time and new one can be installed in a short time with ease.

However, among the bolts for firmly fixing the roll pack module 119 to the machine frame 101, there is a bolt 124 (see FIG. 6), for example, which is located behind the air cylinder 121 and to which it is difficult to access to head portion of the bolt by tools such as a spanner and a box wrench because the air cylinder 121 interferes with such tools. To cope with this problem, in order to remove the fastening bolt 124, it has been necessary that the air cylinder 121 is inclined left or right (as shown in two-dotted line in FIG. 6), or the air cylinder itself is once removed entirely from the machine frame 101.

Further, as shown in FIG. 5, when the wide width timing-belt 111 is to be removed from the pulleys 112, 113 and the idler pulley 114, the tension arm 115 itself should be removed from the machine frame 101. In this case, since the number of the bolts to be removed is large, there has been a problem that such operation is troublesome and time-consuming.

SUMMARY OF THE INVENTION

One object of the present invention is to over-come the above explained problems in the prior art.

Another object of the present invention is to provide a break roll machine in which a timing belt of a differential transmission mechanism can be removed easily, a pre-assembled roll pack module can be removed from a machine frame in a short time and a new roll pack module can be reinstalled in a short time with ease.

According to one aspect of the invention, there is provided a break roll machine having: a fixed roll bearing housing fixed to a machine frame; a movable roll bearing housing which is movable nearer or further with respect to the fixed roll bearing housing; a pair of break rolls rotatably held by the fixed roll bearing housing and the movable roll bearing housing, respectively; a roll gap adjusting mechanism provided between the fixed roll bearing housing and the movable roll bearing housing, for adjusting a gap defined between the pair of break rolls; and a differential transmission mechanism for causing the pair of break rolls to rotate respectively inwardly at different circumferential speeds with each other, the differential transmission mechanism characterized by comprising:

timing-belt pulleys mounted to rotary shafts of the pair of break rolls, respectively;

a timing belt wound on the timing-belt pulleys;

an idler pulley for applying a predetermined tension to the timing belt;

a pair of tension arms which sandwich the idler pulley therebetween and rotatably hold a rotary shaft of the idler pulley at first end portions, and which are mounted rotatably at second end portions, one of the paired tension arms located at an opposite side of the break rolls having at the first end portion a cutout portion which can release the rotary shaft of the idler pulley;

an operation lever for causing the first end portions of the paired tension arms together with the idler pulley to rotate around a pivot point at the second end portions of the tension arms; and a tension adjusting mechanism which moves the operation lever for adjusting a position of the idler pulley.

In the break roll machine as constructed above, when the bolt which pivotally secures the tension arm to the machine frame is removed, the rotary shaft of the idler pulley is released from the fastening state and only the tension arm becomes rotatable around the pivot point of the one end of the tension arm as the center. That is, without the necessity of removing the tension arm entirely from the machine frame and only by removing the minimum number of the bolts, the timing belt of the wide width configuration can be removed without difficulty.

The roll gap adjusting mechanism comprises a connecting rod for connecting the fixed roil bearing housing and the movable roll bearing housing over the pair of break rolls, a lever pivotally and eccentrically mounted to one end portion of the connecting rod, an air cylinder coupled to an outside end portion of the lever through a first coupling means, and a piston of the air cylinder. The first coupling means between the piston and the lever is constituted by an R-pin and a bush.

In this way, since the bush member can be easily pulled out after the R-pin is pulled out by fingers of the operator, the lever and the piston can be easily drawn out.

Further, there is provided a break roll machine in which the second coupling means between the lower end portion of the air cylinder and the machine frame is constituted by a first linkage member which is rotatable to move backward and forward and a second linkage member which is rotatable to move left and right. In this way, the air cylinder becomes possible to be rotated freely in the backward and forward direction and/or in the left and right direction. For example, if the air cylinder is caused to be inclined in the direction of backward or forward, the bolt located behind the air cylinder is exposed so that an access thereto for an operator from the front side becomes available. In this case, as such tool as a spanner or a box wrench can be inserted to the bolt from the front side without being interfered by the air cylinder, such tool can be inserted to the head of the bolt without difficulty. Accordingly, since there is no necessity of such troublesome operation as removing the air cylinder from the machine frame in removing the fastening bolt, it is possible to remove the pre-assembled roll pack module in a short time and to reinstall the new roll pack module with ease and also in a short time.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENT OF THE INVENTION

A preferred embodiment of the present invention will be explained hereunder with reference to the accompanying drawings.

Figure 1:
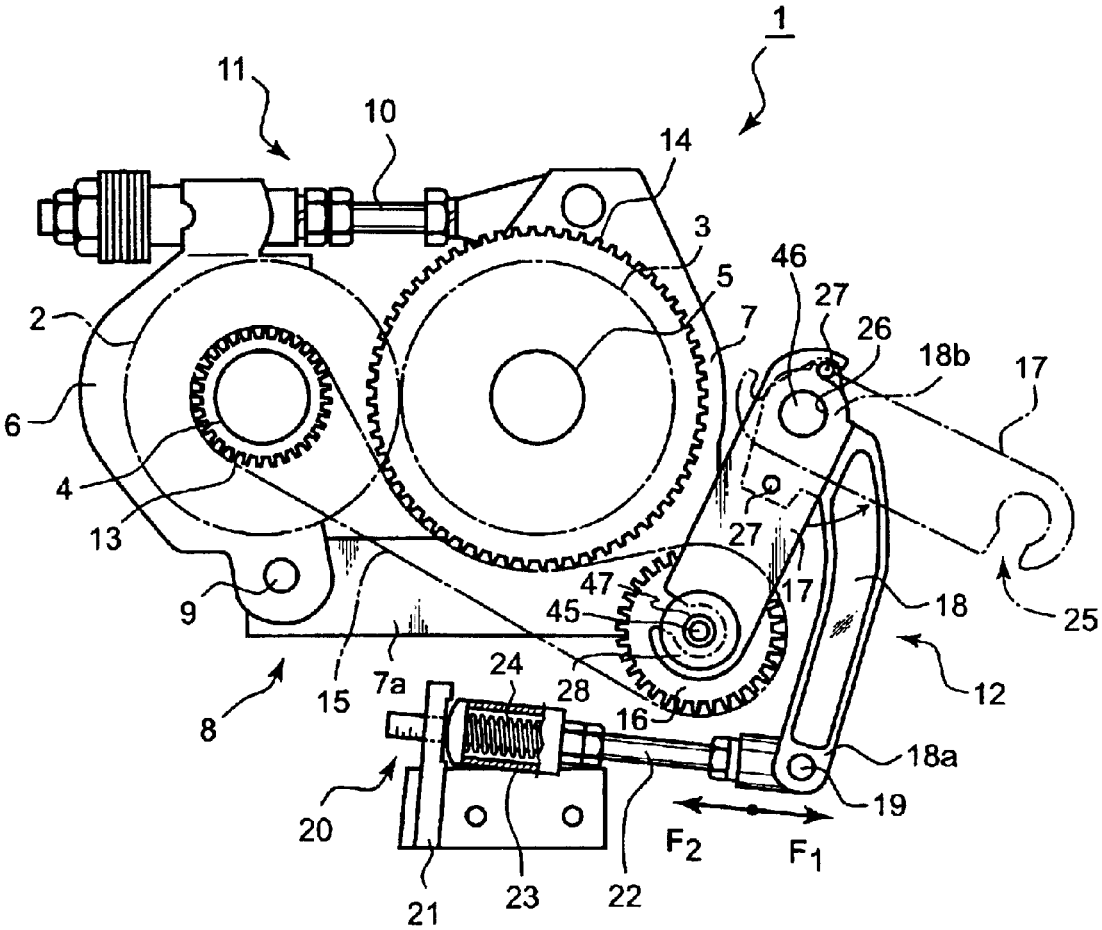
FIG. 1 is a diagrammatic view of the differential transmission mechanism of the break roll machine according to the present invention.
Figure 5:
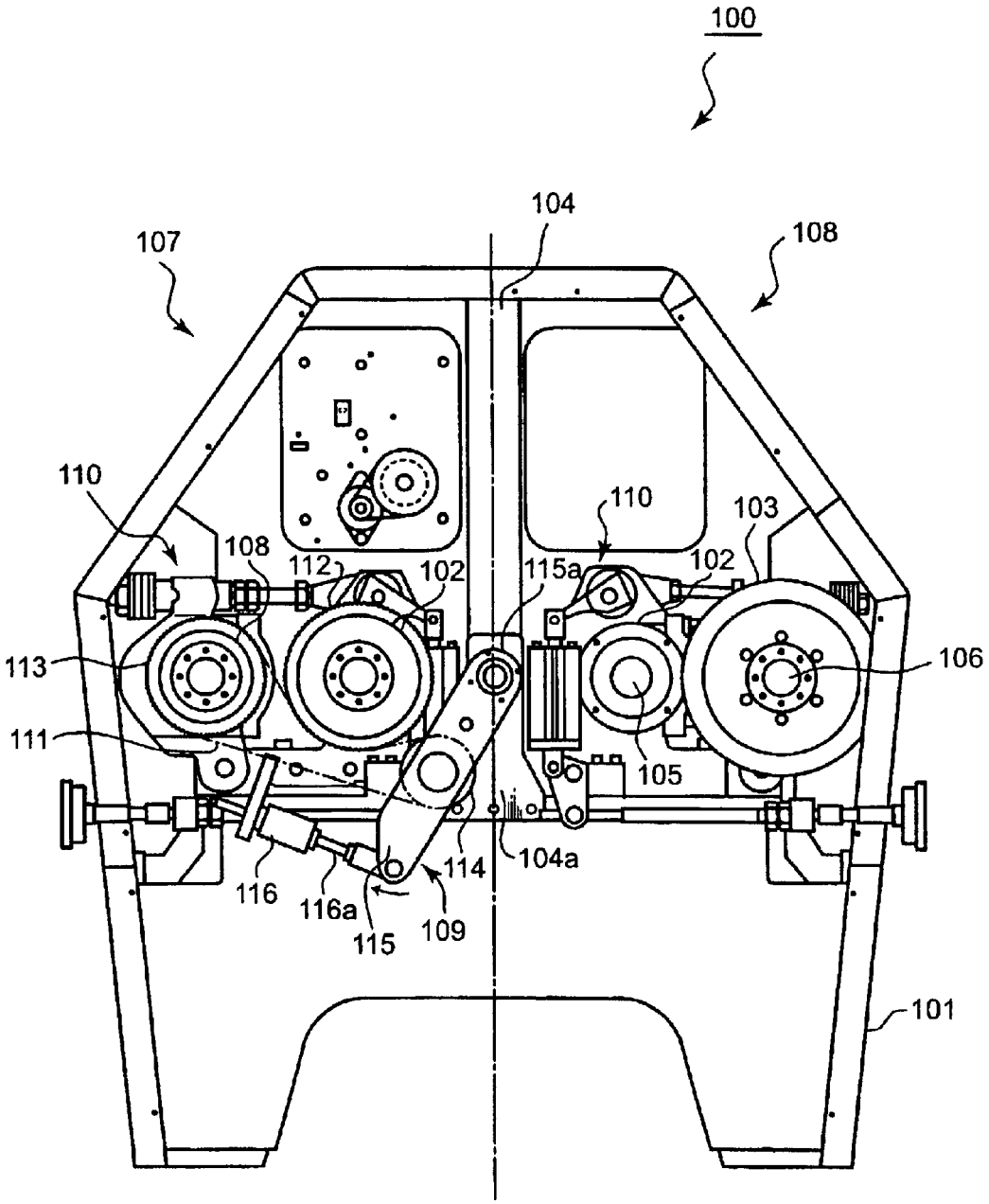
Fig. 5 PRIOR ART
FIG. 5 is a diagrammatic view of the differential transmission mechanism and the roll gap adjusting mechanism of the conventional break roll machine.
Figure 6:
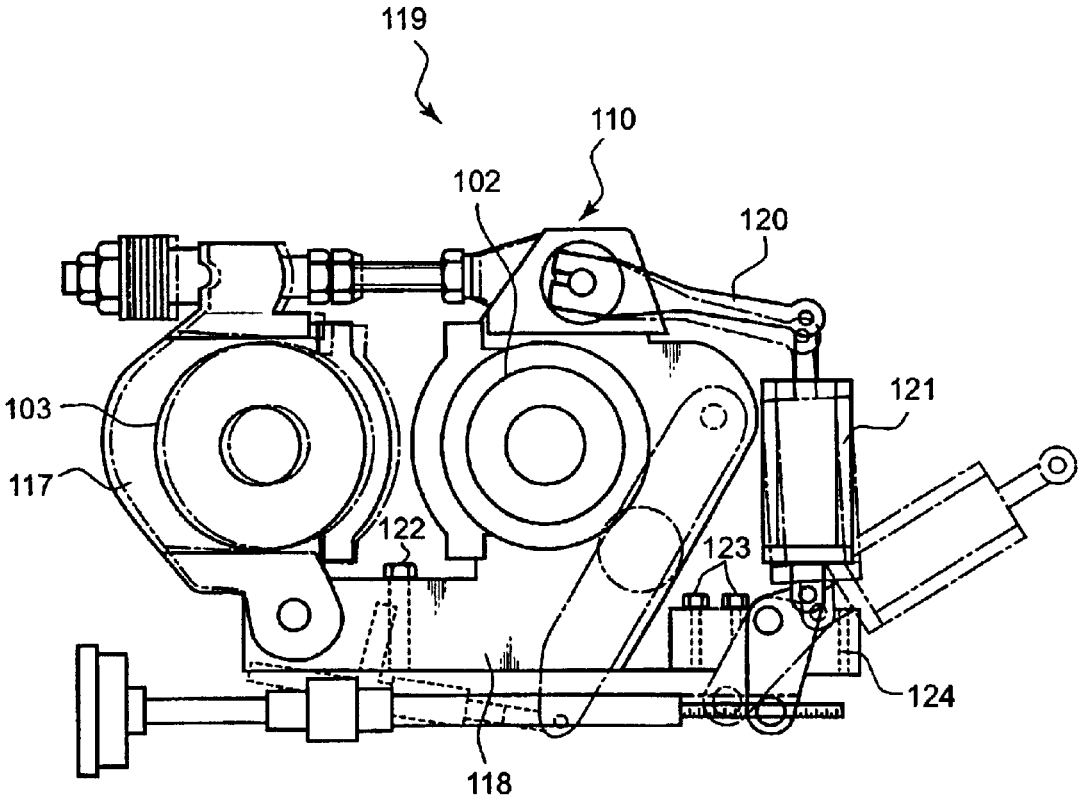
Fig. 6 PRIOR ART
FIG. 6 is an enlarged view of the roll gap adjusting mechanism of the conventional break roll machine.

A differential transmission mechanism and a roll gap adjusting mechanism of the break roll machine, that are featured portions of the present invention, will be explained in detail hereunder. The explanation for other portions common to the conventional machine (shown in FIG. 5 and FIG. 6) is omitted. FIG. 1 shows a differential transmission mechanism of the break roll machine 1, in which the rotating shafts 4, 5 of the break rolls 2, 3 are respectively mounted to a movable roll bearing housing 6 and a fixed roll bearing housing 7 thereby constituting a pre-assembled roll pack 8. The movable roll bearing housing 6 is pivotally connected by a pivot 9 to the bottom part 7*a* of the fixed roll bearing housing 7.

A roll gap adjusting mechanism 11 is provided between the fixed roll bearing housing 7 and the movable roll bearing housing 6 which are connected by a connecting rod 10. The gap between the break rolls 2 and 3 is adjusted to be a predetermined value by the roll gap adjusting mechanism 11.

The differential transmission mechanism for causing the break rolls 2 and 3 to rotate respectively inwardly at different circumferential speeds with each other has the following constructions. To the rotary shaft 4 of the break roll 2, there is mounted a timing-belt pulley 13 having a gear of a smaller diameter. To the rotary shaft of the break roll 2, a timing-belt pulley 14 having a gear of a larger diameter is mounted. A timing belt 15, which has a wide width and has on both the sides uneven portions at regular intervals, is wound over both the timing-belt pulleys 13 and 14. Beneath both the timing-belt pulleys 13 and 14, there is provided an idler pulley 16 which applies an appropriate tension to the timing belt 15 by pulling thereof. To the idler pulley 16, a pair of tension arms 17 (only one of the paired tension arms is shown in FIG. 1) are mounted in such a manner that they sandwich the idler pulley 16 therebetween at both the ends of the rotary shaft 45. To the pivotal rotary shaft 46 inserted into the opening 26 at an upper end portion of the tension arm 17, an operation lever 18 is attached. The operation lever 18 is provided with a tension adjusting mechanism 20 through a pivotal rotary shaft 19 arranged at the lower end portion of the operation lever 18. The tension adjusting mechanism 20 causes the operation lever 18 to move left or right in FIG. 1, thereby changing the position of the above idler pulley 16. The tension adjusting mechanism 20 is constituted by, starting from the pivotal rotary shaft 19, a threaded rod 22 slidably mounted on a fixed plate 21, a coil housing cylinder 23 threaded on the threaded rod 22, and a coil spring 24 mounted on the threaded rod 22 and compressed between one end of the coil housing cylinder 23 and the fixed plate 21. Due to the expansion force of the coil spring 24, the operation lever 18 is pushed at the pivotal rotary shaft 19 and is urged in the arrow direction F1 in FIG. 1. The tension adjusting mechanism 20 is so constructed that, by rotating the coil housing cylinder 23 threaded on the threaded rod 22, the urging power is enhanced with the operation lever 18 being moved in the arrow direction F2 in FIG. 1 along the rod 22, whereas the urging power is decreased with the lever 18 being moved in the direction of F1.

Figure 2:
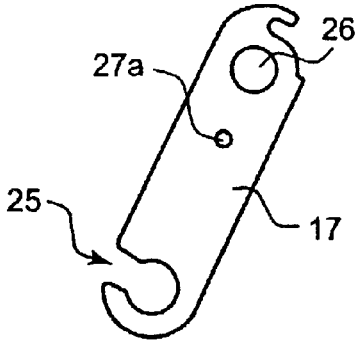
FIG. 2 is a plane view of the tension arm of the differential transmission mechanism according to the present invention.

As shown in FIG. 2, one of the paired tension arms 17 (that is, the one shown in FIG. 1) is provided with the opening 26 into which the pivotal rotary shaft 46 can be inserted and a screw inserting hole 27*a* into which a screw fixedly connecting the operation lever upper portion 18*b* and the upper portion of the tension arm 17 is inserted. Further, the tension arm 17 is provided with a cutout portion 25 which can release the rotary shaft 45 from the tension arm 17 so that only the tension arm 17 can rotate with the pivotal rotary shaft 46 as the center.

Next, the way how the timing belt 15 is removed from the machine as constructed above is explained. First, the operation lever 18 is moved in the arrow direction F1 in FIG. 1 along the threaded rod 22 by rotating the coil housing cylinder 23, thereby decreasing the urging power. In response thereto, the operation lever lower end portion 18*a* together with the lower end of the tension arm 17 are rotated in the left direction (F2 direction) in the drawings with the pivotal rotary shaft 46 being as the center, whereby the timing belt 15 is loosened. Next, the screw 47 fixing the tension arm 17 and the rotary shaft 45 of the idler pulley 16 is removed. Further, the screws 27, 27 fixing the operation lever upper portion 18*b* to the upper potion of the tension arm 17 are removed. Further, when the washer 28 is removed, the rotary shaft of the idler pulley 16 is released from the tension arm 17 through the cutout portion 25 and the tension arm 17 becomes rotatable around the pivotal rotary shaft 46 as the center. Accordingly, the tension arm 17 can be moved to the rest position as shown by an imaginary line (two-dotted line) in FIG. 1. Namely, without the necessity of removing the tension arm 17 entirely from the machine frame, it has become possible that the wide width timing belt 15 can be removed by only removing the minimum number of screws (three of the screw 47 and the screws 27 and 27 in total).

Figure 3:
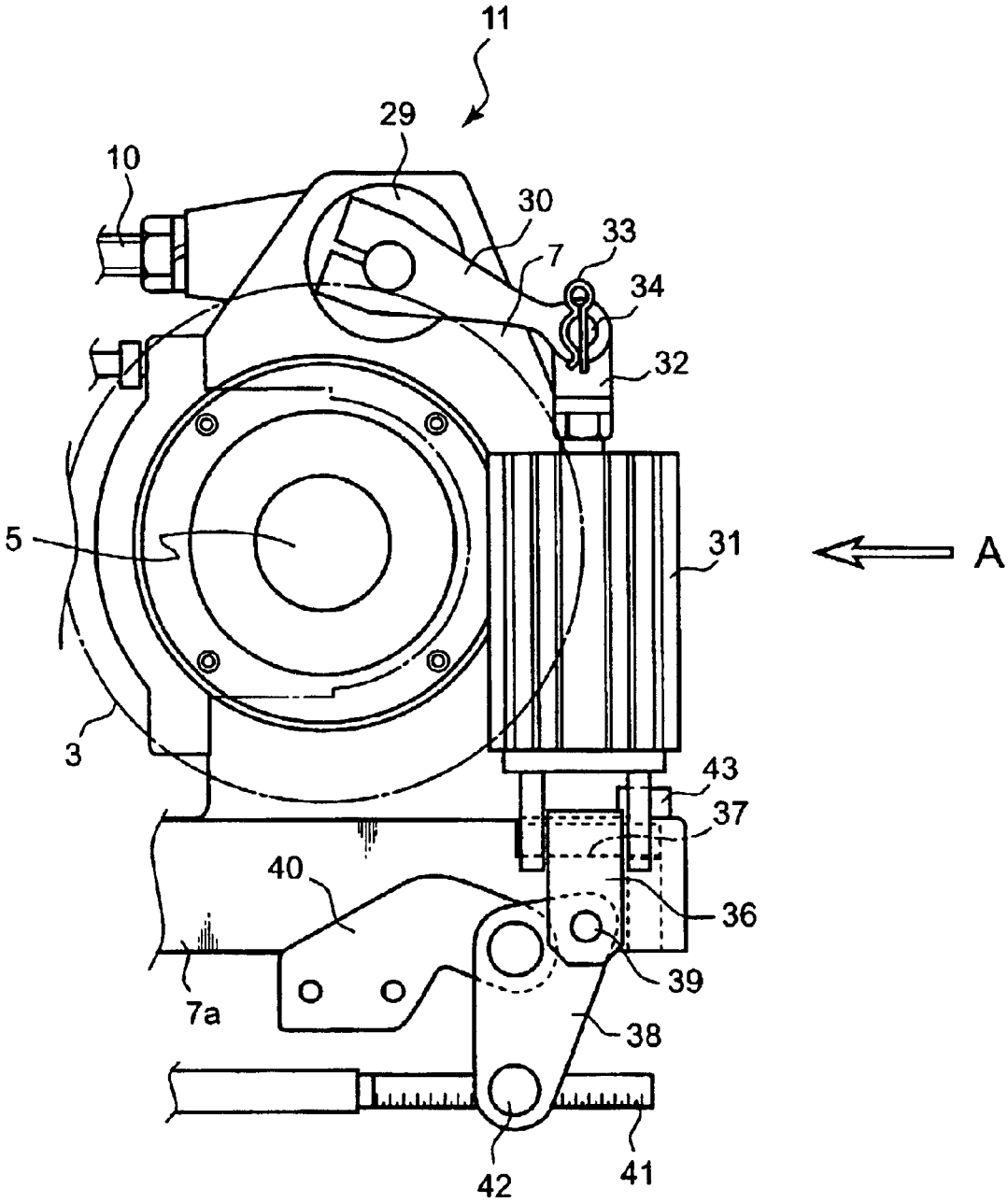
FIG. 3 is a diagrammatic view of the roll gap adjusting mechanism of the break roll machine according to the present invention.
Figure 4:
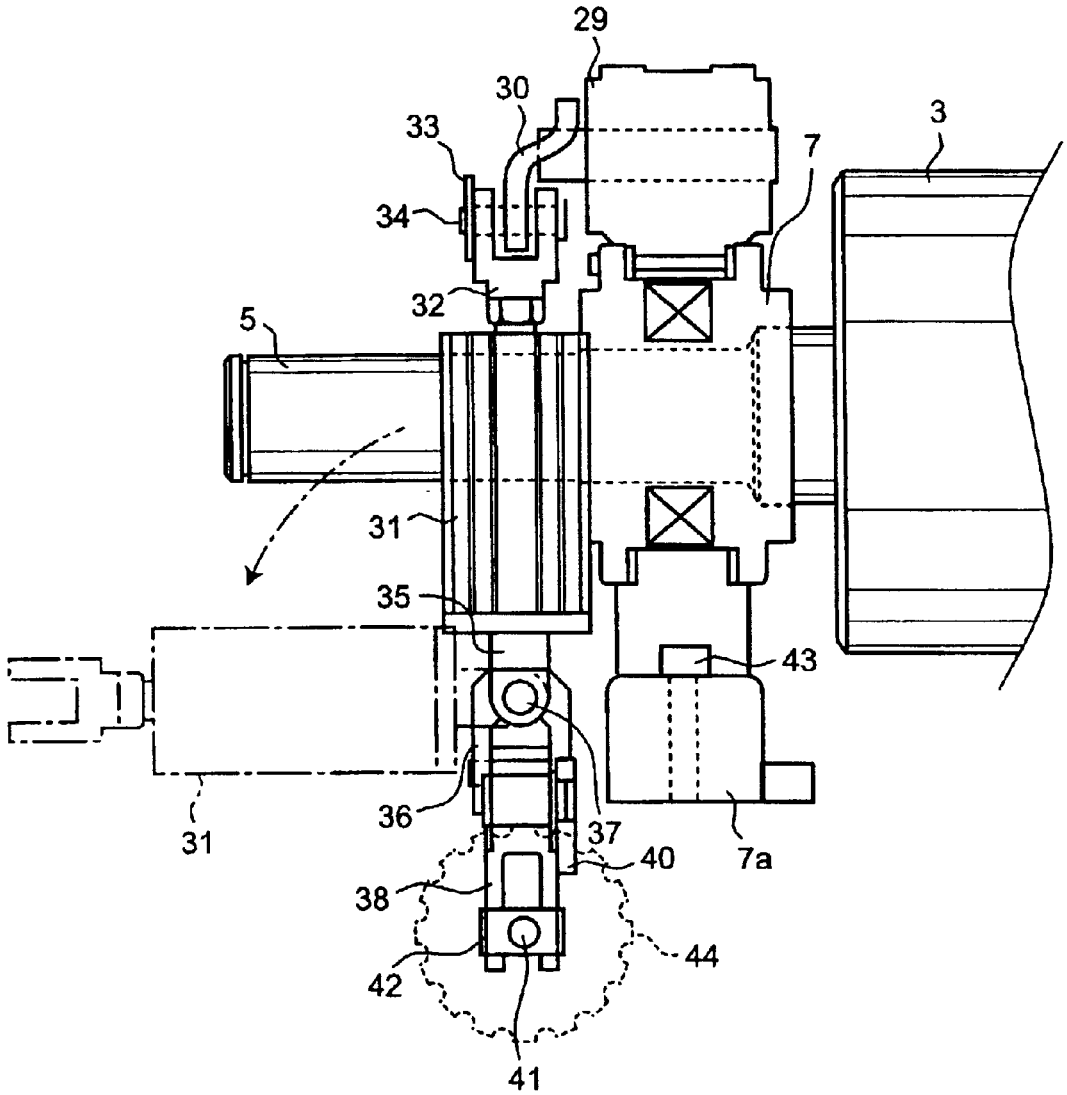
FIG. 4 is a diagrammatic view of the roll gap adjusting means seen from the arrow A direction in FIG. 3.

Next, by referring to FIG. 3 and FIG. 4, the features of the roll gap adjusting mechanism of the present invention will be explained. FIG. 3 shows a part of the roll gap adjusting mechanism of the break roll machine. FIG. 4 is a side view seen from the arrow direction A in FIG. 3. The roll gap adjusting mechanism 11 wherein the fixed roll bearing housing 7 and the movable roll bearing housing 6 are connected by a connecting rod 10 is provided, at one end portion 29 of the connecting rod 10, with a lever 30 which is rotatable and is eccentrically mounted. To the outer end portion of the lever 30, a piston 32 of an air cylinder 31 is rotatably coupled by a combination of an R-pin and a bush 34. The lower end portion of the air cylinder 41 is provided with a first linkage member 35 which allows the rotational movement of the air cylinder 31 in the direction of backward and forward (left and right in FIG. 4) when the connection between the piston 32 of the air cylinder 31 and the lever 30 is released. Further, there is provided a second linkage member 36, at the lower end portion of the first linkage member 35, which allows the rotational movement of the air cylinder 31 in the direction of left and right (backward and forward in FIG. 4) when the connection between the piston 32 and the lever 30 is released. The coupling between the first and second linkage members 35 and 36 is effected through a bush 37. The lower end portion of the second linkage member 36 is rotatably connected to a lever 38 through a pin 39. The lever 38 itself is rotatably attached to a fixed plate 40 firmly fixed to the machine frame. Further, to the lower end of the lever 38, there is coupled, through a rotating resisting member 42, an adjusting rod 41 which adjusts the roll gap in the order of 0.04 mm per one round of the handle 44 (see FIG. 4) manually operated by an operator.

Hereunder, the procedure for removing the roll pack of the break roll machine constructed as above is explained. Upon pulling out the R-pin 33 by the operator's fingers, the bush 34 can easily be removed from the piston 32, whereby the lever 30 and the piston 32 can be easily separated from each other. Since the air cylinder 31 can be freely rotated in the backward and forward directions as well as in the left and right directions by the first linkage member 35 and the second linkage member 36, when, for example, as shown by two-dotted line in FIG. 4, the air cylinder 31 is inclined in the backward or forward direction, the fastening bolt 43 located behind the air cylinder 32 is exposed so that the operator can easily access to the bolt 32 from the front side. In this case, it is possible to insert such tools as a spanner and a box wrench to the head of the bolt 43 from the front side of the machine without being interfered with the air cylinder 31. Therefore, when the bolt 43 is to be removed from the machine frame 101, it has become unnecessary to remove the air cylinder 31 entirely from the machine frame 101, whereby the roll pack module can be removed from the machine frame in a short time and a new pre-assembled roll pack module can be reinstalled easily.

As explained above, according to the present invention, since the tension arm constituting the differential transmission mechanism is so constructed that it is rotatable around the pivotal point of the one end thereof as the center and that there is provided at the other end thereof the cutout portion for releasing the rotary shaft of the idler pulley, when the screws fixing the tension arm are removed, the rotary shaft of the idler pulley is released and only the tension arm becomes rotatable around the pivot point of the one end of the tension arm as the center. That is, there is no necessity of undergoing troublesome operation to remove the tension arm entirely from the machine frame and, as a consequence, the timing belt having a wide width configuration can be easily removed from the machine frame only by removing the minimum number of screws concerned.

Further, since the connection between the piston and the lever constituting the elements of the roll gap adjusting mechanism is formed by the combination of the R-pin and the bush, upon pulling out the R-pin by the operator's fingers, the bush can be removed easily from the piston and, hence, the separation between the lever and the piston can be achieved easily.

Further, since the connection between the lower end portion of the air cylinder and the machine frame is constituted by the combination of the first linkage member and the second linkage member, the air cylinder can be rotated freely in the backward and forward directions as well as in the left and right directions. For example, when the air cylinder is inclined in the backward or forward direction, the bolt located behind the air cylinder is exposed to the front side. In this case, it is possible to insert such tools as a spanner and a box wrench to the head of the exposed bolt from the front side of the machine without being interfered with the air cylinder. As a consequence, it has become unnecessary to remove the air cylinder entirely from the machine frame when the fastening bolt concerned is to be removed, whereby the used roll pack module can be removed from the machine frame in a short time and the new pre-assembled roll pack module can be replaced thereby easily.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A break roll machine having: a fixed roll bearing housing fixed to a machine frame; a movable roll bearing housing which is movable nearer or further with respect to said fixed roll bearing housing; a pair of break rolls rotatably held by said fixed roll bearing housing and said movable roll bearing housing, respectively; a roll gap adjusting mechanism provided between said fixed roll bearing housing and said movable roll bearing housing, for adjusting a gap defined between said pair of break rolls; and a differential transmission mechanism for causing said pair of break rolls to rotate respectively inwardly at different circumferential speeds with each other, said differential transmission mechanism comprising:

timing-belt pulleys mounted to rotary shafts of said pair of break rolls, respectively;

a timing belt wound on said timing-belt pulleys;

an idler pulley for applying a predetermined tension to said timing belt;

a pair of tension arms which sandwich said idler pulley therebetween and rotatably hold a rotary shaft of said idler pulley at first end portions, and which are mounted rotatably at second end portions, one of said paired tension arms located at an opposite side of said break rolls having at said first end portion a cutout portion which can release said rotary shaft of said idler pulley;

an operation lever for causing said first end portions of said paired tension arms together with said idler pulley to rotate around a pivot point at said second end portions of said tension arms; and a tension adjusting mechanism which moves said operation lever for adjusting a position of said idler pulley.

2. A break roll machine according to claim 1, wherein said roll gap adjusting mechanism comprises a connecting rod for connecting said fixed roll bearing housing and said movable roll bearing housing over said pair of break rolls, a lever pivotally and eccentrically mounted to one end portion of said connecting rod, an air cylinder coupled to an outside end portion of said lever through a first coupling means, and a piston of said air cylinder, said first coupling means between said piston and said lever constituted by an R-pin and a bush.

3. A break roll machine according to claim 2, wherein said machine frame and a lower end portion of said air cylinder are connected through a second coupling means, said second coupling means constituted by a first linkage member for allowing said cylinder to incline in the backward and forward directions and a second linkage member for allowing said cylinder to incline in the left and right directions when the coupling of said first coupling means is released.

* * * * *